US010278442B2

(12) United States Patent
Wang et al.

(10) Patent No.: US 10,278,442 B2
(45) Date of Patent: May 7, 2019

(54) FAN MODULE AND HAT WITH FAN MODULE

(71) Applicant: Yung-Ming Wang, Taichung (TW)

(72) Inventors: Yung-Ming Wang, Taichung (TW); Chung-Shien Wang, Taichung (TW)

(73) Assignee: Yung-Ming Wang, Taichung (TW)

( * ) Notice: Subject to any disclaimer, the term of this patent is extended or adjusted under 35 U.S.C. 154(b) by 288 days.

(21) Appl. No.: 15/188,849

(22) Filed: Jun. 21, 2016

(65) Prior Publication Data

US 2016/0377085 A1 Dec. 29, 2016

(30) Foreign Application Priority Data

Jun. 23, 2015 (TW) ..... 104210026 U

(51) Int. Cl.

| | |
|---|---|
| ***A42B 1/06*** | (2006.01) |
| ***F04D 25/06*** | (2006.01) |
| ***A42B 1/00*** | (2006.01) |
| ***F04D 25/08*** | (2006.01) |
| ***F04D 29/28*** | (2006.01) |

(52) U.S. Cl.

CPC ..... *A42B 1/064* (2013.01); *A42B 1/008* (2013.01); *F04D 25/0673* (2013.01); *F04D 25/084* (2013.01); *F04D 29/282* (2013.01)

(58) Field of Classification Search

CPC .. F04D 25/0673; F04D 25/084; F04D 29/282; A42B 1/008; A42B 1/064

See application file for complete search history.

(56) References Cited

U.S. PATENT DOCUMENTS

| | | | | | |
|---|---|---|---|---|---|
| 4,893,356 | A * | 1/1990 | Waters | A42B 1/008 | 2/171.3 |
| 5,425,620 | A * | 6/1995 | Stroud | A42B 1/008 | 2/171.3 |
| 5,878,742 | A * | 3/1999 | Figueredo | A42B 3/288 | 128/201.24 |
| 8,590,062 | B2 * | 11/2013 | Gupta | A42B 1/008 | 2/171.2 |
| 9,486,026 | B1 * | 11/2016 | Cook, Sr. | A42B 1/24 | |
| 9,756,888 | B2 * | 9/2017 | Ku | A42B 1/24 | |
| 2015/0143613 | A1 * | 5/2015 | Chu | A42B 1/008 | 2/171.3 |
| 2016/0100647 | A1 * | 4/2016 | Raiffeisen | F04D 25/0673 | 2/171.3 |
| 2016/0377085 | A1 * | 12/2016 | Wang | F04D 25/0673 | 415/177 |
| 2018/0014596 | A1 * | 1/2018 | Washington | A42B 1/067 | |

* cited by examiner

*Primary Examiner* — Andrew Wayne Sutton

(74) *Attorney, Agent, or Firm* — Lynette Wylie; Apex Juris, PLLC.

(57) ABSTRACT

A fan module and a hat with a fan module are disclosed. The fan module includes a case, a fan, and an air guide tube. The case includes a connecting portion, wherein the case is detachably engaged with a visor of a hat. The case has a receiving space and an air outlet, wherein the air outlet communicates with the receiving space. The fan is rotatably provided in the receiving space of the case. An airflow is generated when the fan rotates, wherein the airflow is exhausted out of the case through the air outlet. The air guide tube is connected to the case, and guides the airflow to a space between the head of a wearer and the main body. Whereby, the hat with the fan module could provide not only sunscreen protection, but also a cooling effect.

4 Claims, 11 Drawing Sheets

FAN MODULE AND HAT WITH FAN MODULE

BACKGROUND OF THE INVENTION

1. Technical Field

The present invention relates generally to a cooling hat, and more particular to a fan module and a hat with a fan module.

2. Description of Related Art

In general, a hat can provide sunscreen protection to prevent sunburn. For instance, a cap includes a crown and a visor, wherein the crown is adapted to cover the head of a wearer, and the visor is provided on the front edge of the crown. While the crown can provide sunscreen protection for the head, the visor can shade sunlight for the face. However, the crown would tightly contact with the head, which would make the wearer feel hot and stuffy in a high-temperature environment, or would even make the wearer sweat heavily. In other words, though the purpose of shading sunlight and sunscreen protection could be achieved by wearing a hat, the wearer could still feel very uncomfortable.

To solve such problem, some hats are made of breathable materials, which allow the wind to contact with the skin of the head through the holes on the hats. Alternatively, there are also hats made of heat dissipation materials, which lowers temperature by letting the wind bring away the heat on the head. Both ways can improve the above problem. However, such hats would not be able to provide the effects of ventilation or heat dissipation in a windless and high-temperature environment.

Therefore, every manufacturer in this industry would like to find a way to develop a hat capable of providing sunscreen protection and cooling effect regardless of the environments in which the wearer is.

BRIEF SUMMARY OF THE INVENTION

In view of the above, the primary objective of the present invention is to provide a fan module and a hat with a fan module, which provide not only sunscreen protection, but also a cooling effect.

The present invention provides a hat, which includes a main body and a fan module. The main body includes a visor. The fan module is connected to the main body, wherein the fan module includes a case, a fan, and an air guide tube; the case is detachably engaged with the visor of the main body; the case has a receiving space; the fan is rotatably provided in the receiving space of the case, and is adapted to generate an airflow when rotates; the air guide tube is connected to the case; the air guide tube is adapted to guide the airflow to a space between a head of a wearer and the main body.

The present invention further provides a fan module, which includes a case and a fan. The case includes a connecting portion, a receiving space, and an air outlet, wherein the air outlet communicate with the receiving space. The fan is rotatably provided in the receiving space of the case, wherein the fan is adapted to generate an airflow when rotates; the airflow is exhausted out of the case through the air outlet.

With the design above, the main body could be engaged with the fan module, and the air guide tube of the fan module could guide the airflow generated by the fan to the space between the head of the wearer and the hat body, which provides a cooling effect.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
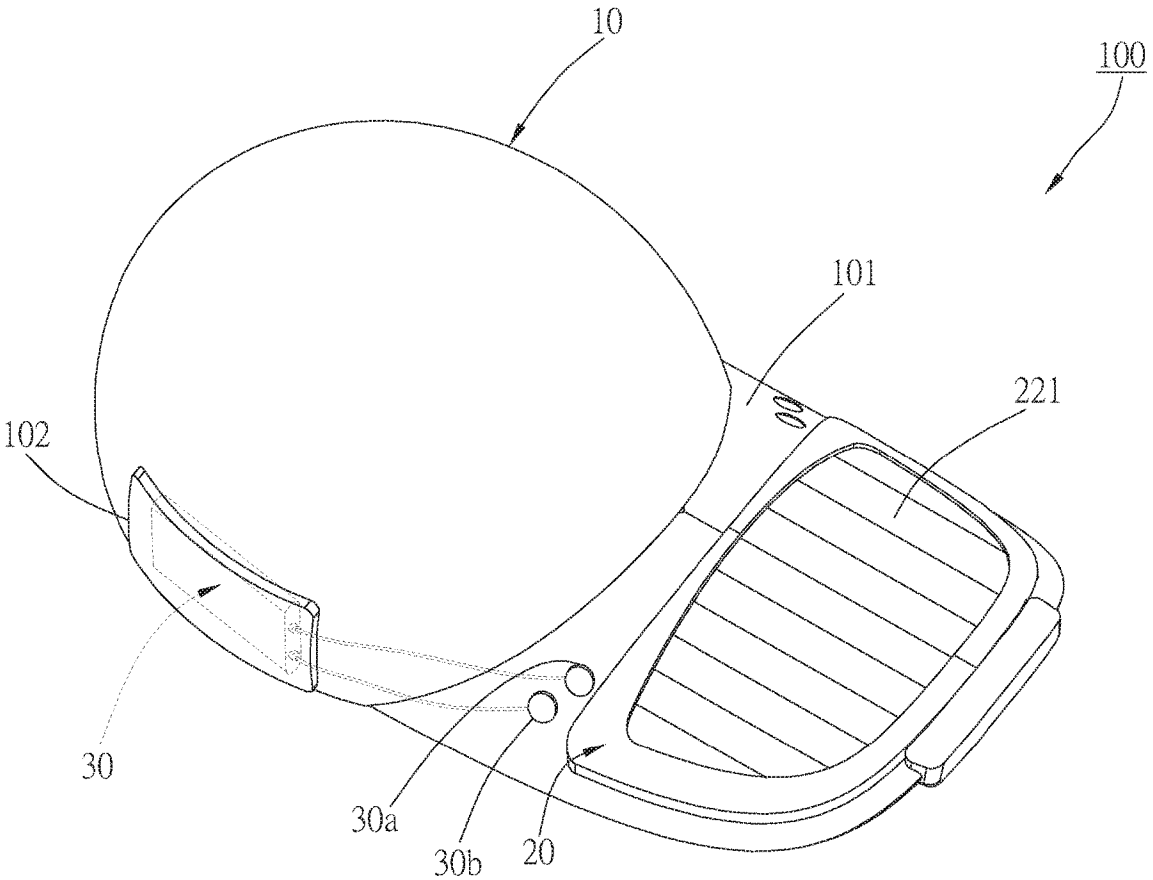
FIG. 1 is a perspective view of the hat of a first embodiment of the present invention.
Figure 2:
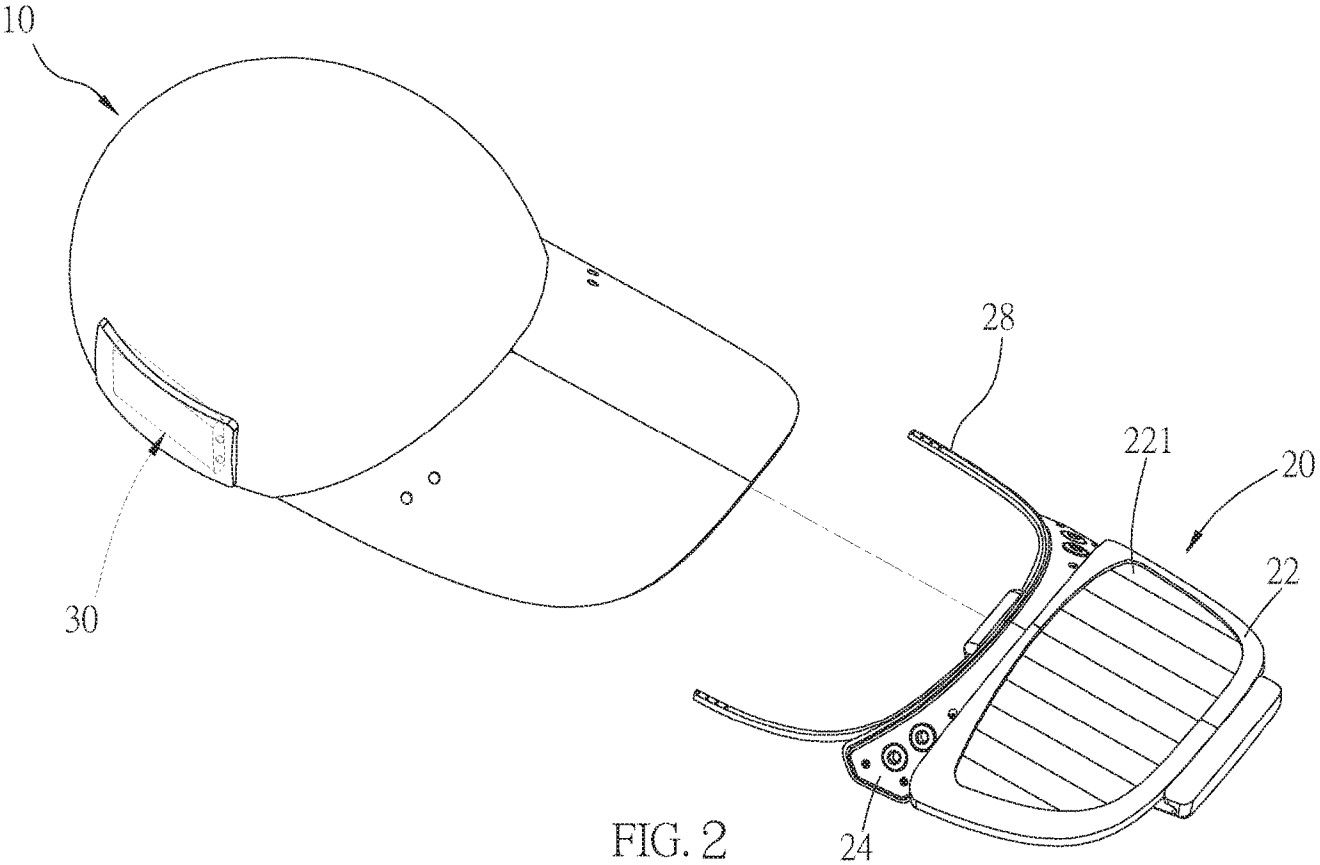
FIG. 2 is an exploded view of the hat of the first embodiment of the present invention.
Figure 3:
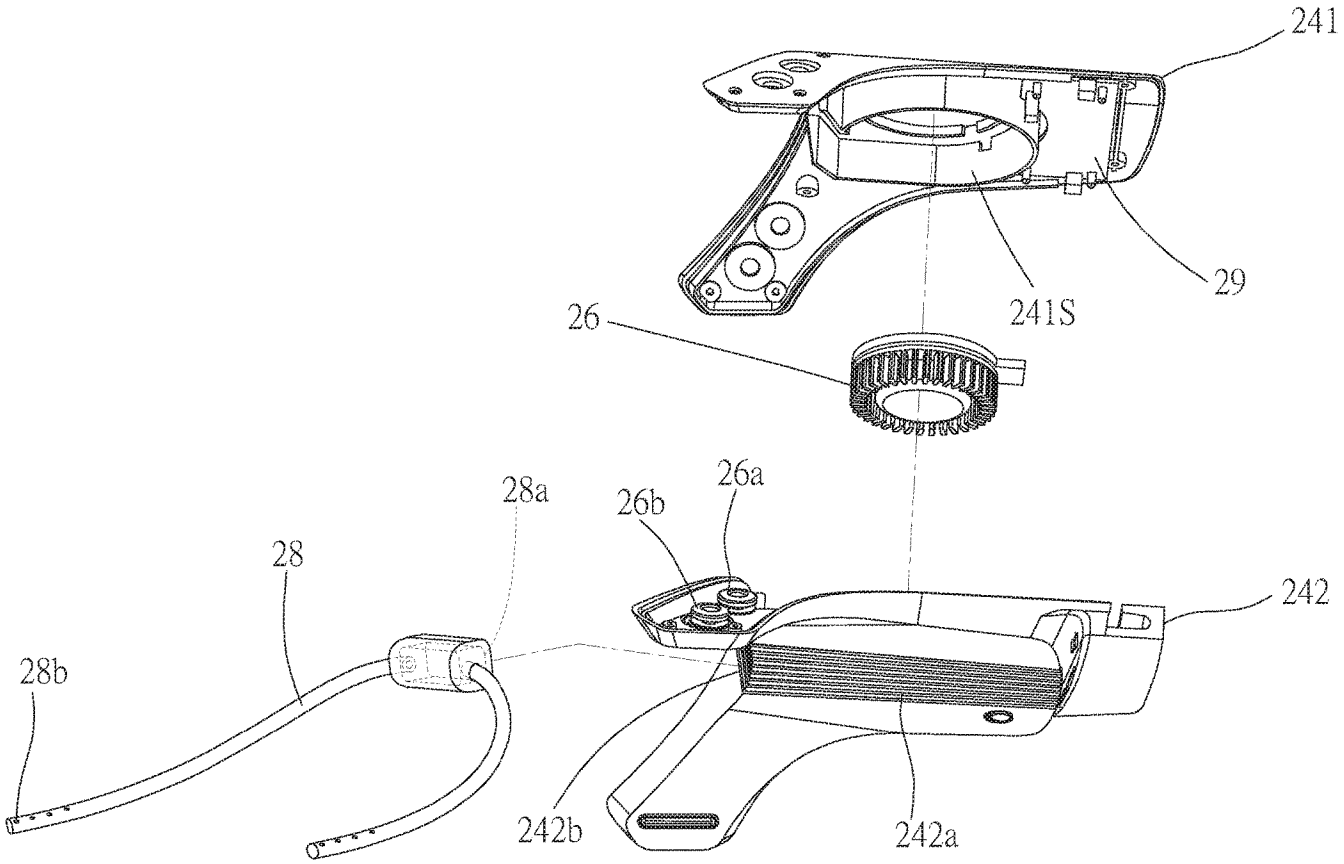
FIG. 3 is a partial exploded view of the hat of the first embodiment of the present invention, showing that the base includes the upper member and the lower member.

As shown in FIG. 1 to FIG. 3, a hat 100 of the first embodiment of the present invention includes a main body 10 and a fan module 20, wherein the main body 10 is adapted to be worn on a head of a wearer, and includes a visor 101 and a lateral pocket 102. The fan module 20 is engaged with the main body 10, and includes a case, a fan 26, an air guide tube 28, and a power source switching device 29, wherein the case is detachably connected to the visor 101 of the main body 10. In the first embodiment, the case includes a plate 22 and a base 24, wherein the plate 22 and the base 24 are connected to each other to have the visor 101 positioned therebetween. In other words, the plate 22 is above the visor 101, while the base 24 is below the visor 101. A solar panel 221 is provided on a top surface of the plate 22, wherein the solar panel 221 could absorb light energy to generate power.

The base 24 includes an upper member 241 and a lower member 242, which match each other, and have a receiving space 241S therebetween. The lower member 242 has an opening 242*a* and an air outlet 242*b*, whereby the receiving space 241S communicates with the outside of the case 24. The fan 26 is rotatably provided in the receiving space 241S of the case 24. An airflow would be generated when the fan 26 rotates. In more details, air from the outside of the base 24 would enter the receiving space 241S through the opening 242*a*, and the airflow would then be exhausted out of the base 24 through the air outlet 242*b* by rotating the fan 26. Additionally, the fan 26 is electrically connected to a pair of first electrode buckles 26*a*, 26*b*, which are projected from an upper surface of the base 24.

Figure 4:
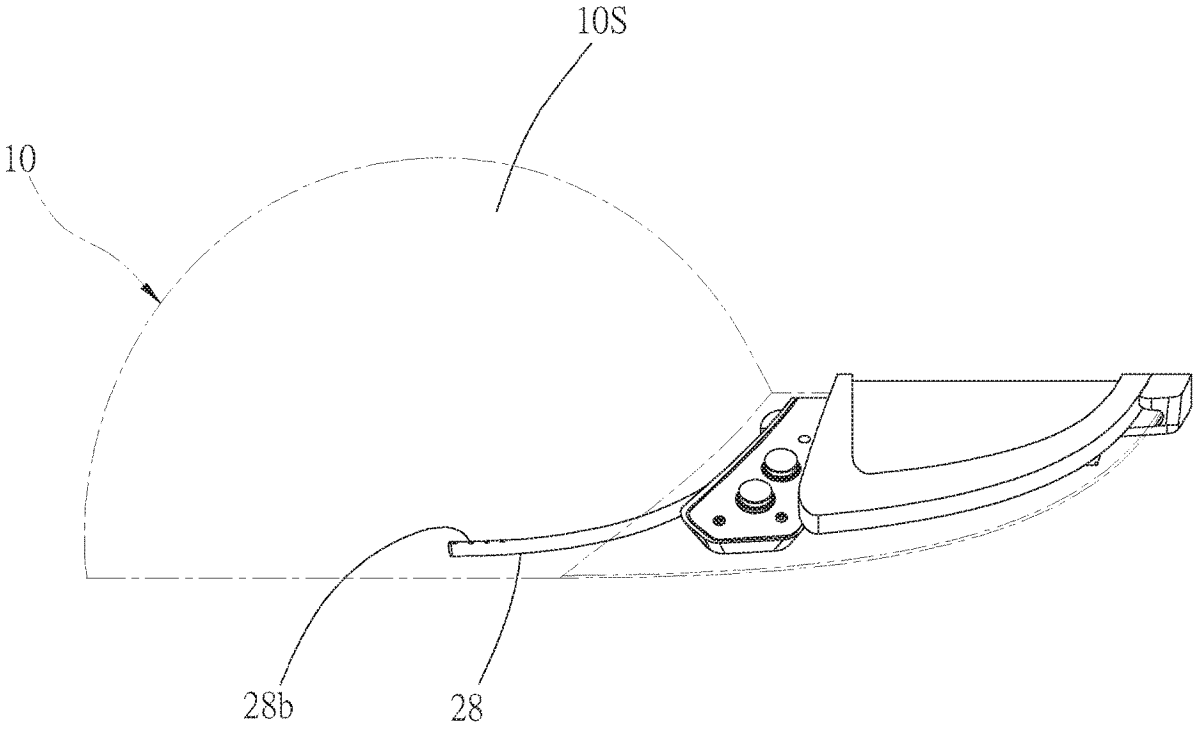
FIG. 4 is a lateral view of the hat of the first embodiment of the present invention, showing an end of the air guide tube is located in the internal space of the main body.
Figure 5:
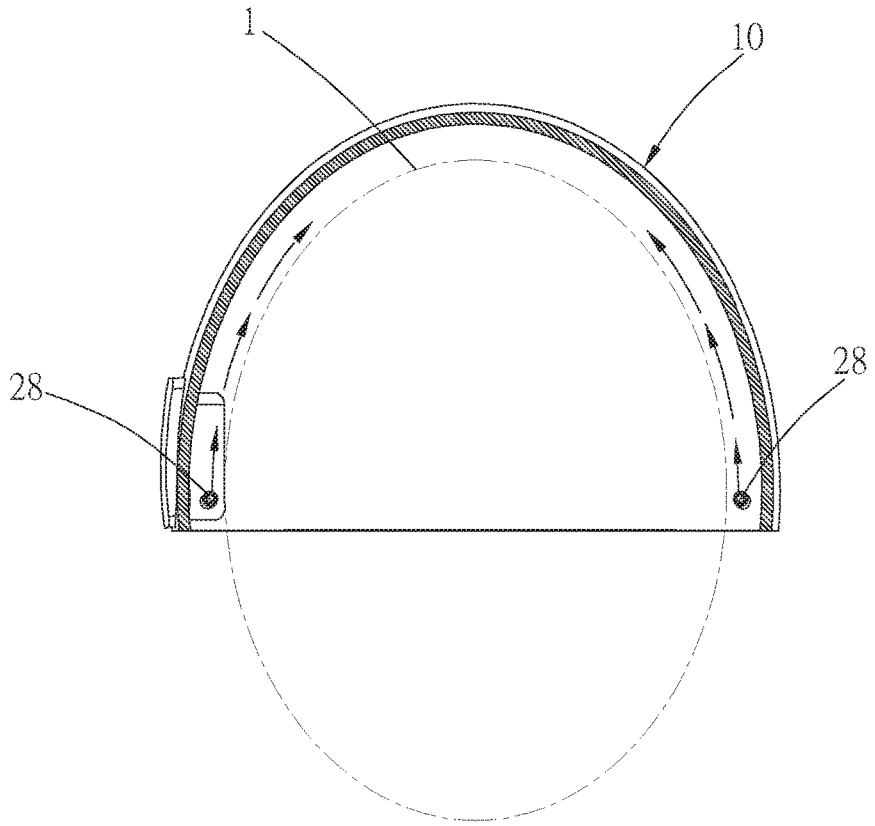
FIG. 5 is a schematic view of the hat of the first embodiment, showing the airflow generated by the fan is guided to the space between the head of the wearer and the main body.
Figure 6:
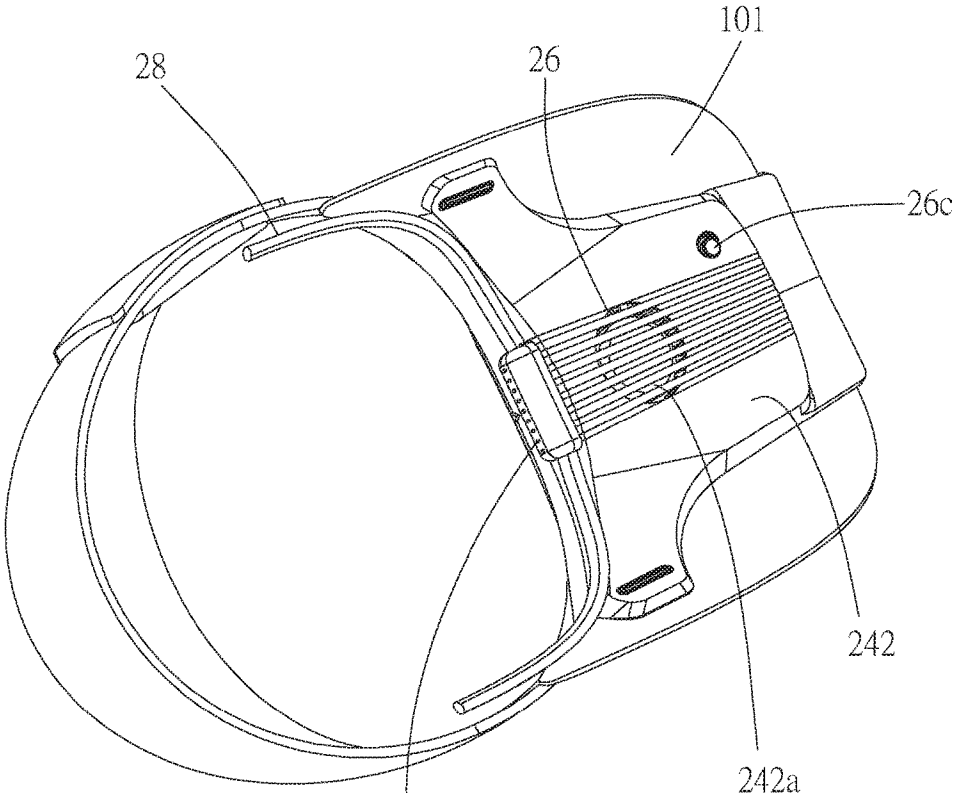
FIG. 6 is a bottom view of the hat of the first embodiment of the present invention.

The air guide tube 28 is connected to the case, and has an air inlet 28*a* and at least an air outlets 28*b*, wherein the air inlet 28*a* communicates with the at least an air outlet 28*b*, and the air inlet 28*a* is connected to the air outlet 242*b* of the base 24, so that the airflow could enter the air guide tube 28 through the air inlet 28*a*, and then be exhausted out of the air guide tube 28 through the air outlets 28*b*. As shown in FIG. 4, an end of the air guide tube 28 which is provided with the air outlets 28*b* is located in an internal space 10S of the main body 10. In this way, as shown in FIG. 5, when a wearer puts on the hat 100 having the fan module 20, the air guide tube 28 could guide the airflow to a space between a head 1 of the wearer and the main body 10 (as indicated by the arrows), i.e., the internal space 10S of the main body 10, providing a cooling effect to the head 1 of the wearer. Therefore, the hat 100 could improve the conventional problem of uncomfortable feeling which would happen due to the tight contact between the main body 10 and the head 1 of the wearer. Also, as shown in FIG. 6, the air guide tube 28 could be further provided with a plurality of air outlets 28*c* corresponding to the air outlet 242*b* of the base 24. As a result, the airflow could also be guided to the forehead of the wearer through the air outlets 28*c*, so that the airflow could flow downward along with the outline of the face.

It is worth mentioning that, in practice, the air guide tube 28 could also be removed. In other words, the airflow generated by the fan 26 could be directly directed to the forehead of the wearer through the air outlet 242*b*, wherein the airflow could also flow downward along with the outline of the face. Whereby, the hat 100 could provide a cooling effect to the face of the wearer without directly flowing winds into the eyes, for the air outlet 242*b* is located appropriately.

As shown in FIG. 1, the hat 100 further includes a battery 30, which is located in the lateral pocket 102 of the main body 10. A pair of second electrode buckles 30*a*, 30*b* are further provided in the visor 101 to correspond two electrodes of the battery 30, wherein the pair of second electrode buckles 30*a*, 30*b* could be engaged with the pair of first electrode buckles 26*a*, 26*b* on the base 24. In this way, when the pair of second electrode buckles 30*a*, 30*b* are engaged with the pair of first electrode buckles 26*a*, 26*b*, the fan module 20 can be firmly connected to the main body 10; at the same time, the battery 30 is electrically connected to the fan 26, whereby the power of the battery 30 can be provided to the fan 30.

Figure 7:
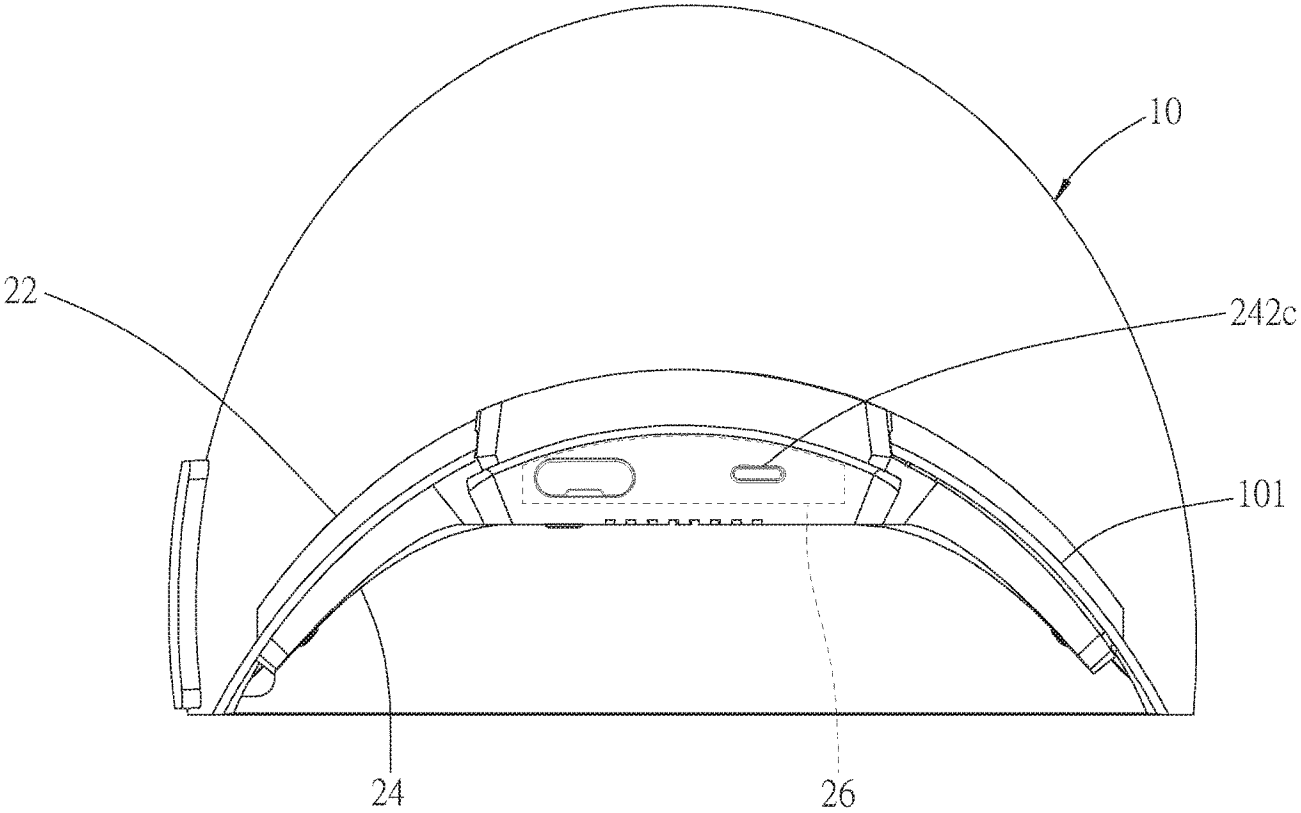
FIG. 7 is a front view of the hat of the first embodiment of the present invention.

As shown in FIG. 7, the top surface of base 24 is curved, and a lower surface of the visor 101 is also correspondingly curved, which ensures the fan module 20 to be firmly connected to the main body 10. Additionally, an adapter 242*c* is further provided on a front edge of the base 24 to be connected to an external power source. In the first embodiment, the adapter 242*c* is adapted to have a USB connector 2 inserted therein, whereby the power of the external power source could be provided to the fan module 20.

Figure 8:
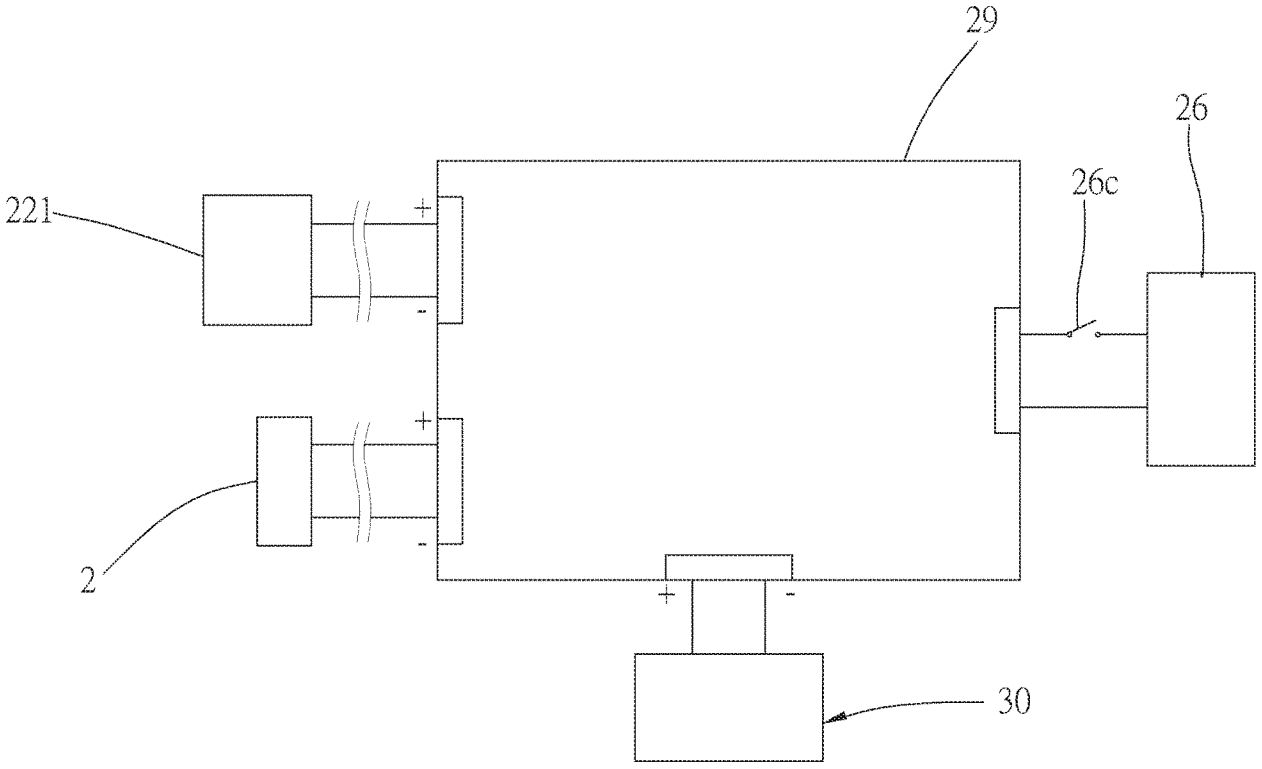
FIG. 8 is a perspective view of the power source switching device of the first embodiment, showing the switching between power sources.

As shown in FIG. 8, the power source switching device 29 is electrically connected to the solar panel 221, the USB connector 2, the battery 30, and the fan 26 at the same time. The power source switching device 29 could store the power generated by the solar panel 221 into the battery 30 if the solar panel 221 could stably generate power. Similarly, when the USB connector 2 is inserted into the adapter 242*c*, the power of the external power source could be stored into the battery 30 through the power source switching device 29. The battery 30 provides power to the fan 30 through the power source switching device 29. Of course, in practice, the power source switching device 29 could be designed in different ways to directly provide the power from the solar panel 221 or the external power source to the fan 26. In addition, a switch 26*c* provided on the lower member 242 could be used to control whether the power provided to the power source switching device 29 should be guided to the fan 26, as shown in FIG. 6.

Figure 9:
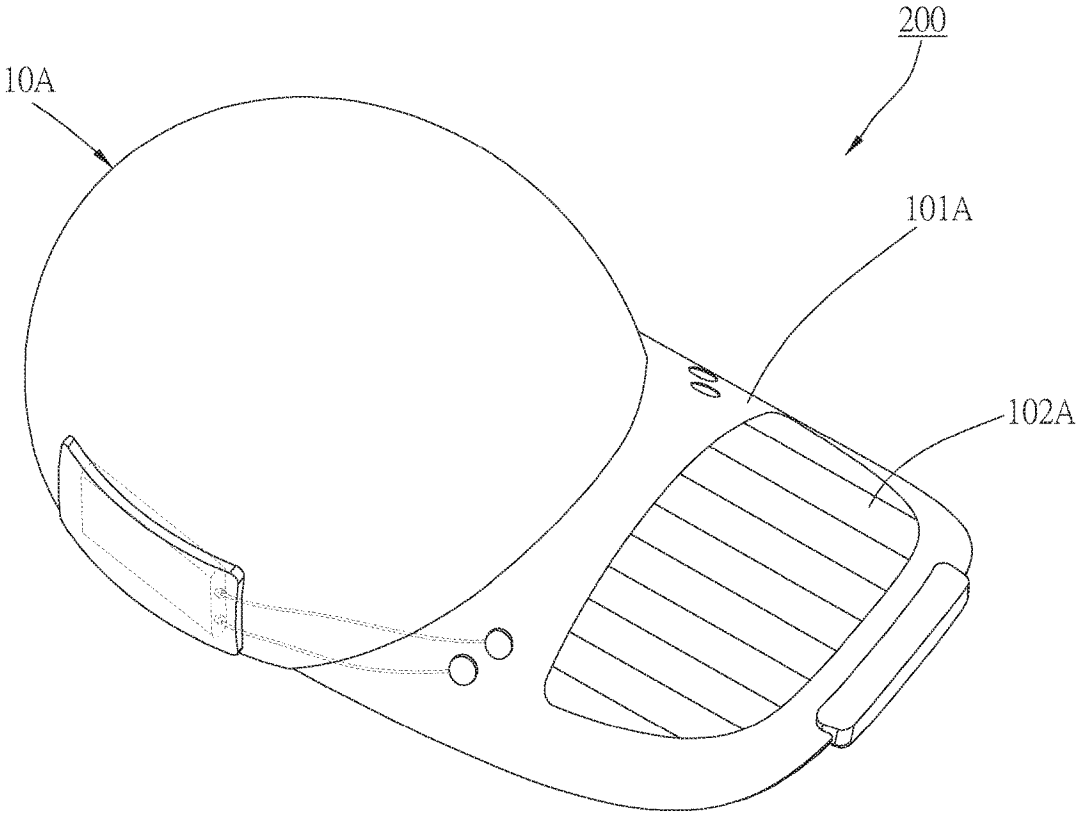
FIG. 9 is a perspective view of the hat of a second embodiment of the present invention.

A hat 200 of the second embodiment of the present invention is illustrated in FIG. 9, wherein a main body 10A thereof also has a visor 101A. However, the difference between the hat 200 of the second embodiment and the hat 100 of the first embodiment is that, a fan module of the hat 200 has no plate. Instead, a solar panel 102A is directly applied onto the upper surface of the visor 101A. Whereby, the manufacturing cost and the weight of the hat could be reduced.

Figure 10:
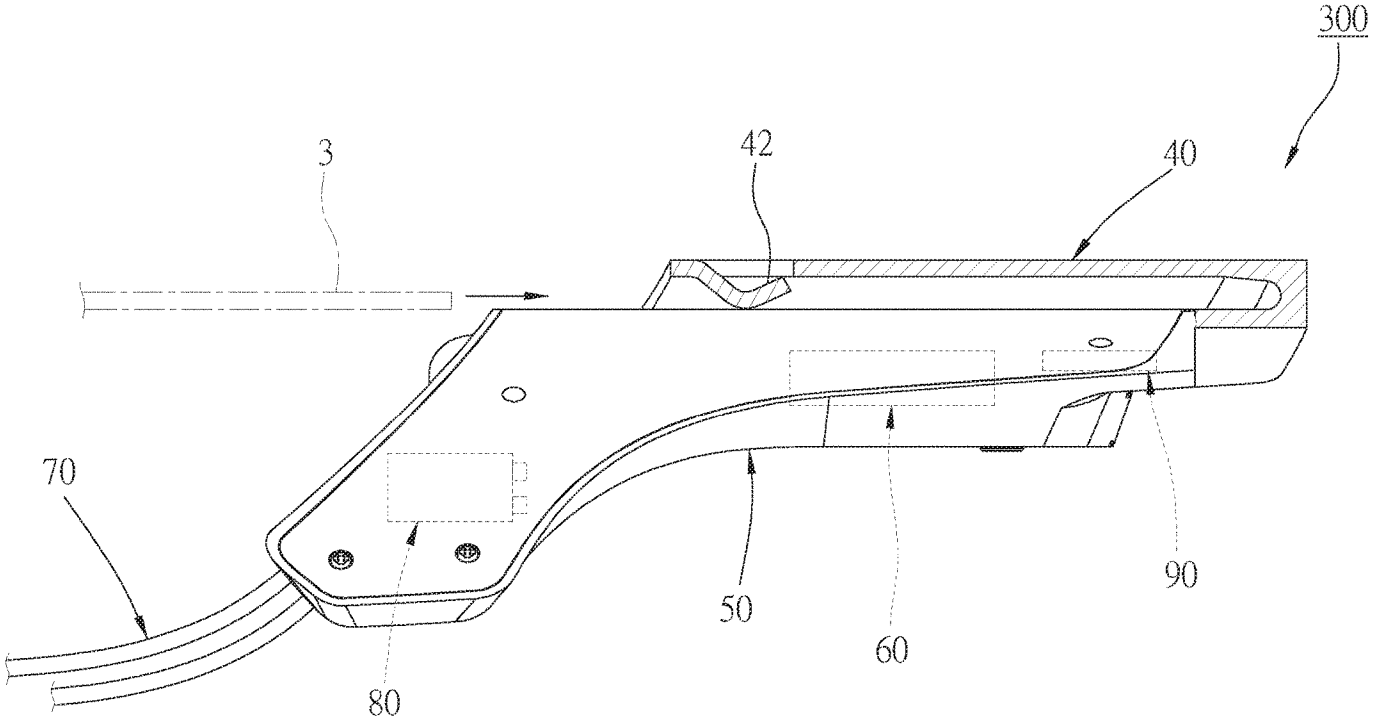
FIG. 10 is a partial sectional view of the hat of a third embodiment of the present invention, showing the plate is provided with a flexible sheet.

As shown in FIG. 10, a fan module 300 of the third embodiment of the present invention includes a plate 40, a base 50, a fan 60, an air guide tube 70, a battery 80, and a power source switching device 90. An end of the plate 40 is connected to the base 50, while another end thereof has at least a press member, which is a flexible sheet 42 as an example. An end of the flexible sheet 42 is firmly connected to the plate 40, while another end thereof abuts against the base 50. A connecting portion, which is a slot 52 as an example, is formed between the plate 40 and the base 50, wherein the slot 52 is adapted to be inserted by a visor 3 (as indicated by the arrow). Once the visor 3 is inserted into the slot 52, a free end of the flexible sheet 42 abuts against the visor 3. The air guide tube 70 is adapted to guide the airflow generated by the fan 60 to the space of the main body, which also provides a cooling effect as well.

The difference between the fan module 300 of the third embodiment and those of the embodiments above is that, a battery 70 of the fan module 300 is directly provided in the base 50, wherein the battery 70, similarly, provides power to the fan 60. In this way, the fan 60 of the fan module 300 could be powered by the battery 70 provided in the base 50. Such fan module 300 would be compatible with any main body having the visor 3. Furthermore, the flexible sheet 42 could fix the fan module 300 onto visors of different sizes.

The power source switching device 90 is electrically connected to the battery 80 and the fan 60, which provides the power of the battery 80 to the fan 60. In addition, similar to the embodiments above, if there is an external power source available, the power source switching device 90 could store the power of the external power source into the battery 80, or directly provides the power of external power source to the fan 60.

Figure 11:
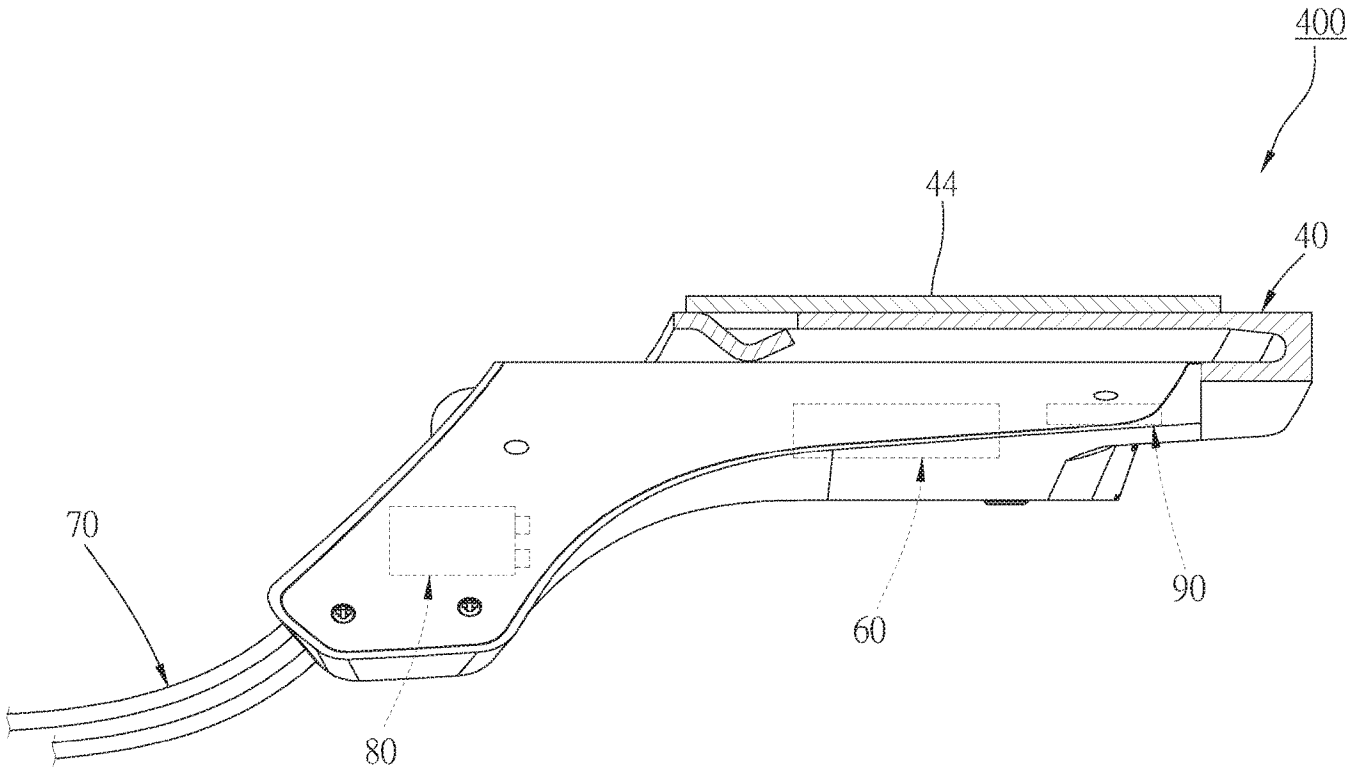
FIG. 11 is a partial sectional view of the hat of a fourth embodiment of the present invention, showing a solar panel is provided on the plate.

As shown in FIG. 11, the difference between a fan module 400 of the fourth embodiment and the fan module 300 is that, a solar panel 44 is further provided on a plate 40 of the fan module 400. Whereby, the fan 60 could be powered in a more energy-saving and environment-friendly way.

In summary, the fan modules provided in the present invention could be engaged with either specific or any types of main bodies. Either way, an excellent cooling effect could provide though the fans and the air guide tubes provided therein.

It must be pointed out that the embodiments described above are only some embodiments of the present invention. All equivalent structures which employ the concepts disclosed in this specification and the appended claims should fall within the scope of the present invention.

What is claimed is:

1. A hat, comprising:

a main body, which includes a visor; and a fan module connected to the main body, wherein the fan module includes a case, a fan, and an air guide tube; the case is detachably engaged with the visor of the main body; the case has a receiving space; the fan is rotatably provided in the receiving space of the case, and is configured to generate an airflow when rotates; the air guide tube is connected to the case; the air guide tube is configured to guide the airflow to a space between a head of a wearer and the main body.

2. The hat of claim 1, wherein the case includes a plate and a base, which communicate with each other, and have the visor provided therebetween; the base is below the visor; the base has the receiving space and an opening communicating with the receiving space.

3. The hat of claim 2, wherein the base includes an upper member and a lower member, which match each other; the receiving space is between the upper member and the lower member; the lower member has the opening.

4. The hat of claim 1, further comprising a battery, wherein the main body comprises a lateral pocket, in which the battery is provided; the fan module comprises a pair of first electrode buckles, which are provided on a surface of the case, and are electrically connected to the fan; the main body comprises a pair of second electrode buckles, which correspond to two electrodes of the battery, and are provided on a surface of the visor; the pair of second electrode buckles are adapted to contact with the pair of first electrode buckles to electrically connect the battery to the fan, which is adapted to be powered by the battery.

* * * * *